United States Patent [19]

Testa

[11] 4,147,045

[45] Apr. 3, 1979

[54] COMBINATION LOCK WITH SCRAMBLER

[75] Inventor: Frank J. Testa, Southington, Conn.

[73] Assignee: Lori Engineering Corporation, Southington, Conn.

[21] Appl. No.: 875,237

[22] Filed: Feb. 6, 1978

[51] Int. Cl.[2] ..... E05B 37/00

[52] U.S. Cl. ..... 70/314

[58] Field of Search ..... 70/314, 301, 302, 303 R

[56] References Cited

U.S. PATENT DOCUMENTS

| | | | |
|---|---|---|---|
| 2,244,152 | 6/1941 | Hamilton | 70/314 |
| 2,436,859 | 3/1948 | Eras | 70/314 |
| 3,339,302 | 9/1967 | Miller | 70/314 |
| 3,447,348 | 6/1969 | Davenbaugh | 70/314 |
| 3,481,167 | 12/1969 | Barner | 70/314 |

*Primary Examiner*—Robert L. Wolfe

[57] ABSTRACT

A conventional rotatable tumbler combination lock of the type having notched rotatably mounted tumblers, a notched rotatably mounted drive plate, a bolt plate and bolt movable between locked and unlocked positions, a lever pivotally mounted to said bolt plate and having a fence for engagement with said tumbler notches and a dog for engagement with said drive plate to allow movement of bolt to said unlocked position, the improvement comprising including a scrambler mechanism which includes a rod having one end rotatably mounted to the bolt plate and another end adapted for engagement of detents on the tumblers. The rod engages said detents when the lock is in the open position and when the lock is closed, the rod spins the tumblers and the engagement of the dog with the drive plate notch and the fence with the tumbler notches is upset.

4 Claims, 3 Drawing Figures

COMBINATION LOCK WITH SCRAMBLER

BACKGROUND OF THE INVENTION (1) Field of the Invention

This invention relates to combination locks having an automatic scrambling mechanism whereby the operating mechanism of the lock is scrambled upon closing of the lock to automatically upset the unlocking alignment of the operating mechanism thereby eliminating the need of manual scrambling by a person operating the lock.

(2) Description of the Prior Art

A persistent problem in the combination lock art has been the danger of the lock being opened by an unauthorized person if the unlocking mechanism has not been completely scrambled or upset. The problem arises when an authorized person dials the correct combination, opens the lock and then closes the lock without disturbing the final setting. Since the final setting of the lock has placed the lock mechanism in proper alignment to accomplish the unlocking movement, it is possible in many locks for an unauthorized person to open the lock.

U.S. Pat. No. 3,481,167 to Elwood M. Barner, discloses a scrambling mechanism for a combination lock. This patent discloses a rotatable tumbler combination lock having a resiliently mounted cam which interacts with a cam surface on the dog lever to disengage the dog mechanism upon movement of the bolt to the unlocked position and return the dog mechanism to the locked position. A spring normally urges the dog mechanism towards the position of engagement so that engagement for unlocking is accomplished when the tumblers and the driving disc are properly aligned. Movement of the bolt plate toward the unlocked position removes the spring bias from the dog mechanism and the resiliently mounted cam disengages the dog mechanism for return to the locked position when the dial is released.

U.S. Pat. No. 3,447,348 also discloses a scrambling mechanism for a combination lock. This patent discloses an upset mechanism which includes a resilient spring which is mounted to the casing of the lock and which engages detents in the tumblers of the lock to scramble the lock. A disadvantage with this type of scrambler is that it requires an elongated spring which is subject to wear.

It is an object of the present invention to provide a simplified scrambler mechanism for a conventional combination lock. It is also an object of the present invention to provide a scrambler mechanism which is subject to less wear than is known in the prior art.

SUMMARY OF THE INVENTION

The present invention provides a novel scrambler mechanism for a conventional combination lock. The conventional combination lock is of the type having notched rotatably mounted tumblers, a notched rotatably mounted drive plate, a bolt plate and bolt movable between lock and unlocked positions, a lever pivotably mounted to the bolt plate and having a fence for engagement with the tumbler notches and a dog for engagement with the drive plate notch to allow movement of the bolt to the unlocked position. The novel scrambling mechanism includes a rod having one end rotatably mounted to the bolt plate and the other end adapted for engagement with detents on the tumblers.

The scrambling mechanism includes a bolt return means for driving the engaged rod against the detent on the tumbler to rotate the tumblers and thus upset the engagement of the dog with the drive plate notch and upset the fence with the tumbler notches.

DETAILED DESCRIPTION OF THE INVENTION

The scrambler of the present invention may be incorporated in conventional combination locks. U.S. Pat. No. 3,481,167 to Elwood M. Barner describes such a conventional combination lock. For operation of parts of the lock other than the scrambler mechanism of the present invention, the disclosure of this patent may be referred to and is hereby incorporated by reference.

Figure 1:
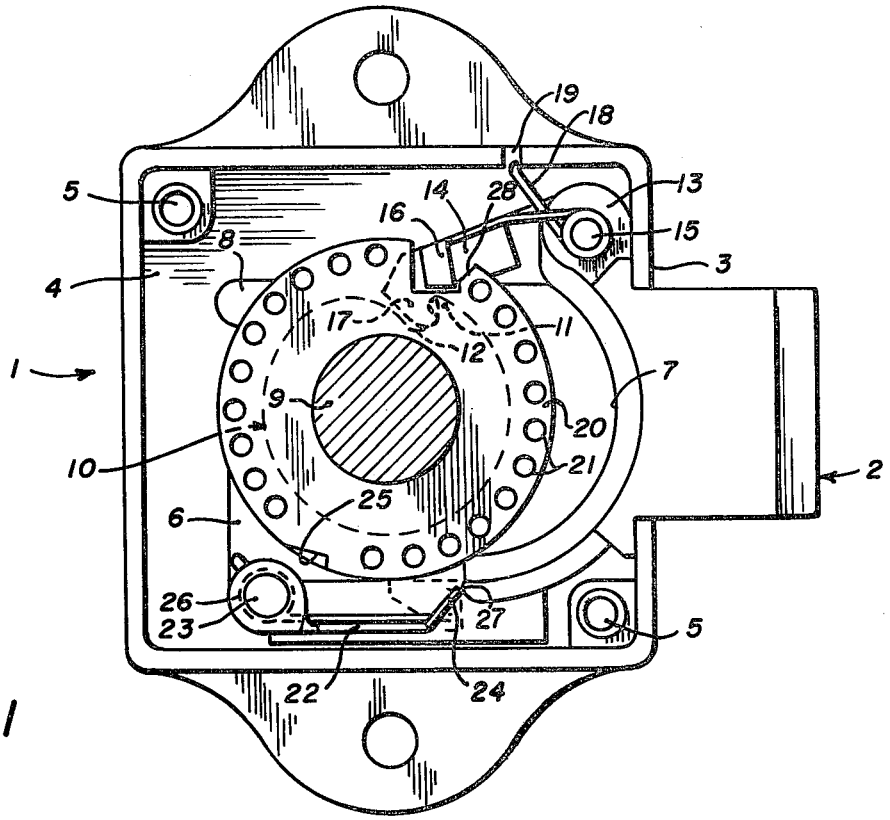
FIG. 1 shows a view from the rear of the lock of the parts and their relative positions upon completion of the dialing of the correct combination and just prior to unlocking of the lock.
Figure 2:
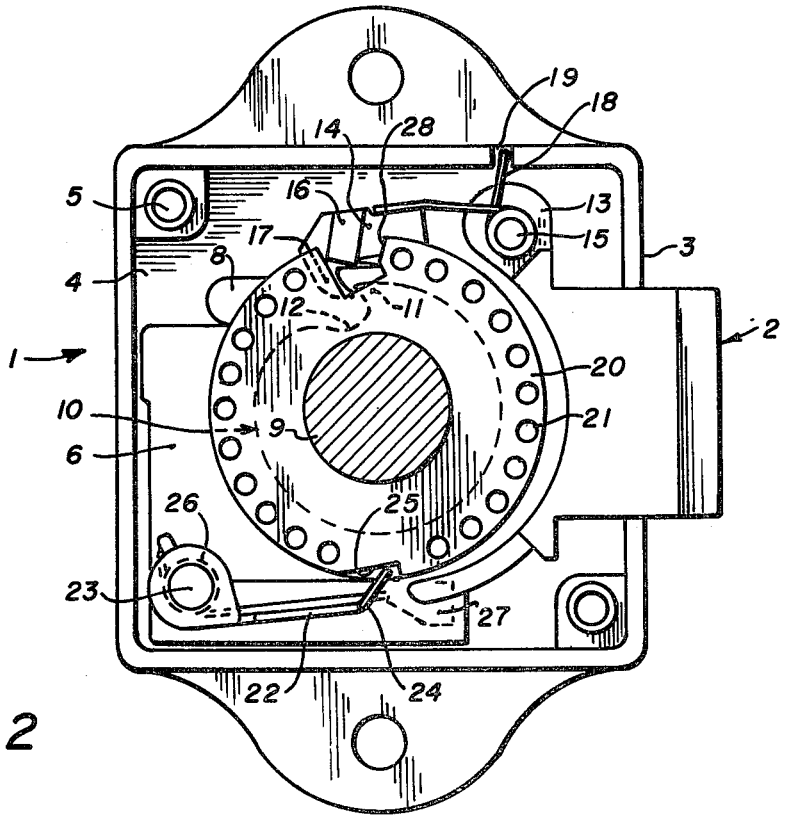
FIG. 2 shows the lock shown in FIG. 1 after the lock has been opened.
Figure 3:
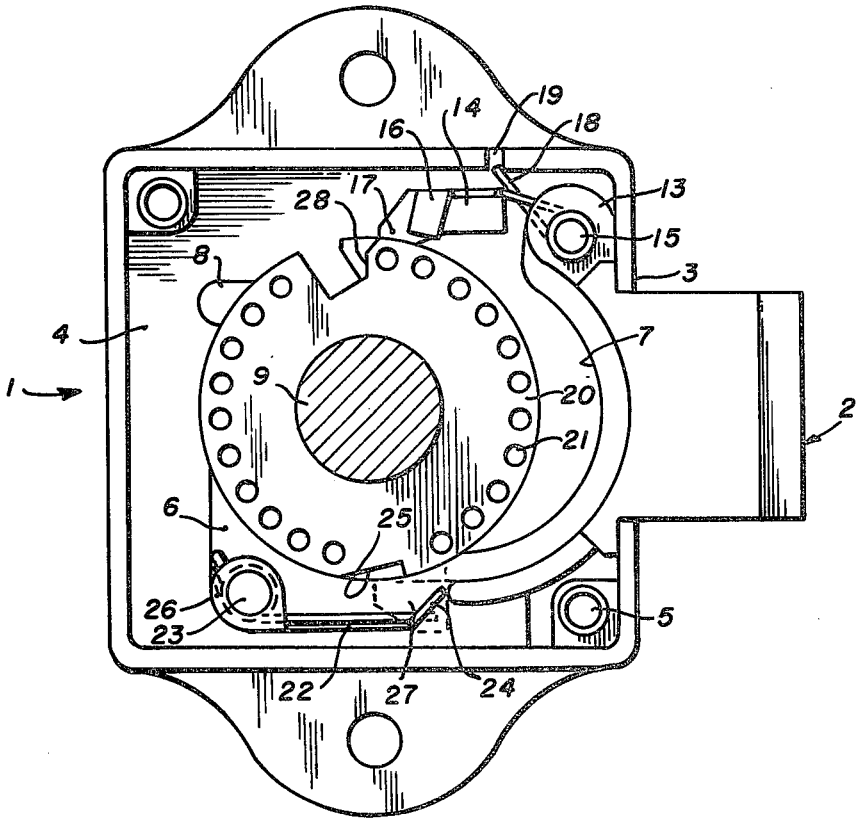
FIG. 3 shows the lock of FIGS. 1 and 2 after the lock has been closed and the operating mechanism within the lock scrambled.

Referring to FIGS. 1, 2 and 3, a combination lock indicated generally at 1 is shown mounted in structure with which it might be associated such as, for example, a Post Office Box having a door in which lock 1 is mounted and bolt 2 extends into a casing for locking. Lock 1 includes a conventional dial plate on which the combination numbers are displayed and a knurled operating post connected to the dial plate (not shown). Lock 1 is shown from the rear with the cover of the casing 3 removed to expose the mechanism within casing 3. The interior surface 4 of the front part of casing 3 can be seen along with screw posts 5 into which screws fasten to secure the cover of casing 3. A bolt plate 6 is positioned immediately adjacent interior surface 4, bolt 2 being an integral part and an extension of bolt plate 6. Bolt plate 6 is movable laterally with respect to interior surface 4. As shown in FIG. 1, bolt plate 6 and bolt 2 are in the locked position with maximum bolt extension, and unlocking movement would involve the sliding of bolt plate 6 and bolt 2 left with respect to the position shown. Bolt plate 6 has an open central section defined by edge 7 so that the bolt plate can slide without interference with other parts of the mechanism. The bottom part of bolt plate 6 is guided along the lower part of casing 3 and the upper part of the bolt plate is guided by a guidepost 8 mounted on interior surface 4 so that straight movement of bolt plate 6 and bolt 2 are accomplished without canting.

An arbor 9 is rotatably mounted and extends into the interior of casing 3. A drive plate 10 is connected to arbor 9 so that drive plate 10 is rotated by arbor 9. Drive plate 10 may be permanently fixed to arbor 9 and arbor 9 is connected to be driven by operating post (not shown). Thus, rotation of operating post causes rotation of arbor 9 and drive plate 10. Drive plate 10 has a section which is formed into the shape of a hook 11 having a notch 12.

A mounting post 13 extends from bolt plate 6, mounting post 13 being integral with bolt plate 6 but recessed from interior surface 4 to define a space between post 13 and interior surface 4. A dog lever 14 is positioned adjacent interior surface 4 above bolt plate 6 and one end of dog lever 14 extends into the space between post 13 and surface 4, and this end of the dog lever is pivotally connected to bolt plate 6 by pin 15. Thus, dog lever 14 is connected to bolt plate 6 but can move pivotally with respect to the bolt plate. A fence 16 extends from dog lever 14 toward the interior of the lock structure for tumbler engagement. A dog 17 at the end of dog lever 14 removed from the pivoted connection is adapted for engagement with notch 12.

A torsion spring 18 is mounted on pin 15, and torsion spring 18 imparts a force to dog lever 14 urging the dog lever counterclockwise against the periphery of drive plate 10. One end of torsion spring 18 normally bears against the right hand surface of an opening in the top of casing 3, and the other end of spring 18 bears against a flat surface on the top of dog lever 14 so that the dog lever is urged in a counterclockwise direction toward the periphery of drive plate 10. The arrangement of the lock mechanism in FIG. 1 shows the parts in their relative position when the dog has dropped into the notch in drive plate 10 upon completion of the dialing of the combination and just prior to unlocking the bolt. Ordinarily, dog 17 would ride against the outer periphery of drive plate 10 rather than be positioned in the notch as shown in FIG. 1.

None of the structure described to this point with respect to FIG. 1 is attached to the cover of the casing 3. The structure attached to the backing plate includes a pair of tumblers 20 (only one of which can be seen in FIG. 1). The tumblers have a series of evenly spaced holes 21 around their periphery corresponding to the numbers of the dial plate and each tumbler has associated therewith a finger which is positioned in a selected hole to set the combination for the lock. The structure described to this point has been a standard prior art combination lock mechanism without a scrambler.

The scrambler mechanism of the present invention includes rod 22 which is rotatably mounted at one end to bolt plate 6 by pin 23 which extends from bolt plate 6. Rod 22 includes an upwardly bent end portion 24 which is shaped to engage detent 25 on tumbler 20 and a similar detent on the second tumbler (not shown). Spring 26 urges rod 22 toward the periphery of tumbler 20 and the other tumbler (not shown).

The scrambling mechanism and its operation can be illustrated by a description of the operation of the lock. Assuming that the lock is in the locked position with the combination scrambled and is to be unlocked, the dial plate is turned in the usual fashion to select the proper combination of numbers. Movement of the dial plate acts through arbor 9 to turn drive plate 10. Drive plate 10 drives tumblers in a manner well known in the art by contact between fingers and projections as those disclosed in U.S. Pat. No. 3,481,167. The dialing of the proper combination results in the alignment of plate notch 12 and tumbler notches 28 so that fence 16 is aligned with the tumbler notches and dog 17 is aligned with drive plate notch 12. The force of spring 18 then drives dog lever 14 downwardly and causes dog 17 to engage notch 12. The lock mechanism is then in the position shown in FIG. 1 and is ready for opening.

Movement of bolt 2 to the open position is accomplished by additional rotation of drive plate 10 in the counterclockwise direction as viewed in FIG. 1, whereby dog lever 14 is pulled to the left and pulls with it bolt plate 6 to which it is pivotally connected, thus opening the bolt by pulling bolt 2 to the left.

Referring to FIG. 2, lock 1 is shown with bolt 2 in the open position. Once bolt 2 together with bolt plate 6 reaches the open position, end portion 24 of rod 22 is urged upwardly by spring 26 into detent 25 on the periphery of tumbler 20 and a detent in a tumbler not shown. It should be understood that when the lock is being opened, rod 22 of scrambling mechanism moves with respect to camming abutment 27 which is fixedly mounted to the cover of the casing 3. Camming abutment 27 is shaped with respect to end portion 24 of rod 22 to allow rod 22 to move upwardly into detent 25. The manner in which the scrambling mechanism of the present invention functions is apparent from the drawings. Referring to FIG. 1, end portion 24 of rod 22 is in its withdrawn position and is abutted by camming abutment 27 so as to be out of contact with the tumbler 20. As bolt plate 6 and bolt 2 is withdrawn to the left as shown in FIG. 2, end portion 24 of rod 22 is urged upwardly by the force of spring 26. End portion 24 of rod 22 slides along the face of camming abutment 27 until end portion 24 slides past camming abutment 27 and is urged into detent 25 on the periphery of tumbler 20. When the arbor 9 is released, bolt plate 6 and bolt 2 are urged toward the right as shown in the FIGURES and end portion 24 of rod 22 engages detent 25 and spins or rotates tumbler 20 into the position shown in FIG. 3. As the bolt plate 6 is moved toward the right, camming abutment 27 engages end portion 24 to move the rod 22 downwardly toward the retracted position shown in FIG. 3. As is also apparent from the drawings, camming abutment 27 is fixed with respect to the casing 4 so that the rod moves with respect to the camming abutment.

As shown in FIG. 3, when bolt plate 6 is allowed to spring back to the closed position, end portion 24 of rod 22 engages detent 25 and rotates tumbler 20 and the other tumbler (not shown) in a counterclockwise rotation thus scrambling tumblers 20. Tumblers 20 are no longer in position wherein unlocking can occur because the tumblers have been rotated from the unlocking position and the fence 16 has been withdrawn. Similarly, dog 17 has been withdrawn from notch 12 in drive plate 10 after rotation away from the unlocked position. It should be understood that as shown in FIG. 3, tumbler 20 has been rotated out of position about 360° from the position shown in FIG. 2.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In a combination lock of the type including a lock casing and a cover for the casing, and having notched rotatably mounted tumblers, a notched rotatably mounted drive plate, a bolt plate and bolt movable between locked and unlocked positions, a lever pivotally mounted to said bolt plate and having a fence for engagement with said tumbler notches and a dog for engagement with said drive plate notch to allow movement of said bolt to said unlocked position, the improvement comprising a scrambling mechanism comprising:

a detent on at least one of the tumblers;

rod means having one end rotatably mounted to said bolt plate and a second end adapted to engage said detent, said rod means being urged inwardly toward the tumbler by spring means to engage the detent when the lock is in the unlocked position;

camming abutment means for allowing said second end of said rod to engage said detent when the combination lock is in the open position, said camming abutment means extending from said cover into the interior of the lock, the camming abutment means engaging the rod means to prevent the rod means from contacting the tumbler when the lock is in the locked position, said rod means moving with respect to said camming abutment means to a position wherein the rod means moves beyond the camming abutment means and is urged into said detent;

bolt plate return means for driving said rod against said detent to rotate said tumblers and said drive plate and upset the engagement of said dog with said drive plate notch and upset the engagement of said fence with said tumbler notches.

2. A lock according to claim 1 wherein said bolt return means includes a spring biasing said bolt plate and said bolt towards the locked position.

3. A scrambling mechanism for a combination lock as in claim 2 wherein said camming abutment means includes a camming abutment fixedly mounted on a casing cover.

4. A combination lock comprising:

a lock casing;

a plurality of tumbler discs rotatably mounted with respect to said casing, each of said discs having a notch;

a drive plate rotatably mounted with said casing, said drive plate having a notch;

means for transmitting selective movement of said drive plate to said tumbler;

an operating post connected to drive said drive plate;

a bolt plate within said casing and having a bolt extending therefrom, said bolt plate and said bolt movable between a locked position wherein the bolt is extended and an unlocked position wherein the bolt plate is at least partially withdrawn into the casing;

a lever pivotally connected to said bolt plate;

a fence extending from said lever, said fence being adapted for engagement with the notches in said tumblers when said tumblers have been driven to a position for unlocking by movement of said operating post;

a dog on said lever, said dog normally engaging the periphery of said drive plate, said dog being adapted for engagement with the notch in said drive plate when said drive plate has been driven to a position for unlocking by movement of said operating post, said lever, bolt plate and bolt thereby connected to said drive plate for movement to an unlocked position upon further movement of said operating post;

a cover for the casing;

cam abutment means extending from said cover into the interior of the lock;

at least one of said tumblers including a detent on the periphery thereof;

rod means rotatably mounted on one end to said bolt plate and adapted on the second end to engage the detent, said rod means being urged inwardly toward the tumbler by spring means to engage the detent when the lock is in the unlocked position, the camming abutment means engaging the rod means to prevent the rod means from contacting the tumbler when the lock is in the locked position, said rod means moving with respect to said camming abutment means to a position wherein the rod means moves beyond the camming abutment means and is urged into said detent; and bolt return means for driving said rod against said detent to upset the engagement of said dog with said drive plate notch and upset the engagement of said fence with said tumbler notches.

* * * * *